US008182224B1

(12) United States Patent
Liang

(10) Patent No.: US 8,182,224 B1
(45) **Date of Patent: *May 22, 2012**

(54) TURBINE BLADE HAVING A ROW OF SPANWISE NEARWALL SERPENTINE COOLING CIRCUITS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 832 days.

This patent is subject to a terminal disclaimer.

(21) Appl. No.: 12/372,428

(22) Filed: Feb. 17, 2009

(51) Int. Cl.
*F01D 5/18* (2006.01)

(52) U.S. Cl. ..... 416/97 A; 416/97 R

(58) Field of Classification Search ..... 416/97 A, 416/97 R

See application file for complete search history.

(56) References Cited

U.S. PATENT DOCUMENTS 4,542,867 A * 9/1985 Memmen ..... 244/117 A
6,247,896 B1 * 6/2001 Auxier et al. ..... 416/97 R
6,254,334 B1 * 7/2001 LaFleur ..... 415/115
6,280,140 B1 * 8/2001 Soechting et al. ..... 416/97 R
7,527,474 B1 * 5/2009 Liang ..... 416/1
7,717,675 B1 * 5/2010 Liang ..... 416/95
7,753,650 B1 * 7/2010 Liang ..... 416/97 R
7,857,589 B1 * 12/2010 Liang ..... 416/97 R
8,011,888 B1 * 9/2011 Liang ..... 416/92
2010/0183428 A1 * 7/2010 Liang ..... 415/115

* cited by examiner

*Primary Examiner* — Anh Mai
(74) *Attorney, Agent, or Firm* — John Ryznic

(57) ABSTRACT

A turbine blade with an array of cells arranged along the pressure side and suction side of the airfoil to provide near wall cooling to a thin thermal skin that forms the airfoil surface of the airfoil. The blade includes a main spar that forms the support for the thin thermal skin and includes a number of cooling air supply cavities and cooling air discharge cavities formed in an alternating manner along the chordwise length of the airfoil. A row of cells extend along the spanwise direction of the airfoil and includes a mini serpentine flow passage with an inlet hole connected to the adjacent supply cavity and a discharge hole connected to the adjacent collector cavity. The cooling air flow and pressure can be controlled for each of the cells by sizing the metering inlet hole to control the metal temperature of the airfoil as selected locations.

17 Claims, 4 Drawing Sheets

TURBINE BLADE HAVING A ROW OF SPANWISE NEARWALL SERPENTINE COOLING CIRCUITS

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a turbine blade with near wall cooling.

2. Description of the Related Art Including Information Disclosed Under 37 CFR 1.97 and 1.98

A gas turbine engine, such as those used in electric power production with the industrial gas turbine engine, includes a turbine section with multiple rows or stages or turbine blades and vanes that react with a hot gas flow to drive the engine. The efficiency of the engine can be increased by passing a higher gas flow temperature into the turbine. However, the turbine inlet temperature is limited to the material properties of the first stage blades and vanes and the amount of cooling provided to them. Higher temperatures can be used with better cooling of the airfoils.

Besides higher engine efficiencies, designing the engine parts with longer life times also reduces the cost of operating the engine, a short lived part, such as a turbine blade, can significantly reduce the engine efficiency if the part is damaged enough to allow the hot gas flow to leak across the airfoil. Since an IGT engine operates continuously for years before a shut-down is scheduled, a damaged part might have to be used for long periods. It is very costly to shut down and engine and remove the parts for replacement. The down time means that the power plant operator does not have the use of the engine for power production. Also, warranties on the engine require the OEM (Original Equipment Manufacturer) to provide for a minimum period of time in which the engine must, run before a required shut-down is performed. Thus, part life is just as important as the part efficiency or performance in the engine.

In a typical turbine airfoil, such as a rotor blade or a stator vane, the airfoil is exposed to different temperatures. The leading edge is exposed to the highest temperature while the suction side near to the leading edge region is exposed to the lowest temperature. Thus, certain surfaces of the airfoil require more cooling than other surfaces. Also, the airfoil surface is exposed to different pressures. One surface of the airfoil would require a higher cooling air pressure than another area so that hot gas injection does not occur. If the hot gas flow can flow into the cooling air passages formed within the airfoil, significant damage can occur.

A prior art turbine blade with cooling passages is shown in FIG. 1. this prior art blade uses near wall cooling in the airfoil main body that is constructed of radial flow channels in the airfoil walls plus re-supply holes in conjunction with film discharge cooling holes. As a result of this cooling design, the spanwise and the chordwise cooling flow control due to the airfoil external hot gas temperature and pressure variation is difficult to achieve. Also, single radial channel flow is not the best method of utilizing cooling air and results in a low convective cooling effectiveness.

BRIEF SUMMARY OF THE INVENTION

It is an object of the present invention to provide for a turbine blade with an improved near wall cooling effectiveness over the cited prior art airfoils.

It is another Object of the present invention to provide for a turbine blade with a lower wall metal temperature and a reduction of cooling flow requirement than the cited prior art turbine airfoils.

It is another object of the present invention to provide for a turbine blade with a longer part life than the cited prior art turbine airfoils.

It is another object of the present invention to provide for a turbine blade with customized cooling capabilities based on the airfoil external heat load or gas side pressure distribution in both the chordwise and the spanwise direction of the airfoil.

It is another object of the present invention to provide for a turbine blade with a thin wall in order to provide for better near wall convective cooling of the airfoil.

The above objectives and more are achieved in the turbine blade of the present invention that is formed for a main spar that defines cooling air supply cavities and collector cavities on the inside of the walls, and forms an array of mini-serpentine flow cooling modules on the outer surface to provide near wall cooling for the airfoil surface. A thin thermal skin is bonded to the outer airfoil surface and encloses the mini serpentine flow cooling modules. Cooling air from the supply cavity is metered into the various mini serpentine flow modules, flows through the passage and then is discharged into one of the collector cavities. The spent cooling air then flows from the collector cavities and out through film cooling holes formed within the ribs that separate adjacent modules and onto the airfoil outer surface to provide film cooling.

The turbine blade is formed from a main spar and then a thin thermal skin is bonded to the outside to form the airfoil surface and provide for a thin wall airfoil in which a high effective near wall convective cooling can be achieved. The main spar with the mini serpentine flow modules and the ribs form a support surface for the thin thermal skin. The main spar can be cast or machined as a single piece. The thin thermal skin can be formed from the same material or from a different material than the main support spar.

Because of the individual mini serpentine flow modules, the amount of cooling air flow and pressure can be individually designed in order to pass a desired amount of cooling air to the respective section of the airfoil in order to control the airfoil metal temperature to prevent hot spots and to prevent over-cooling. The reduced overall metal temperature results in lower cooling flow requirements, and thus increases the engine efficiency and significantly improves the blade life.

DETAILED DESCRIPTION OF THE INVENTION

Figure 1:
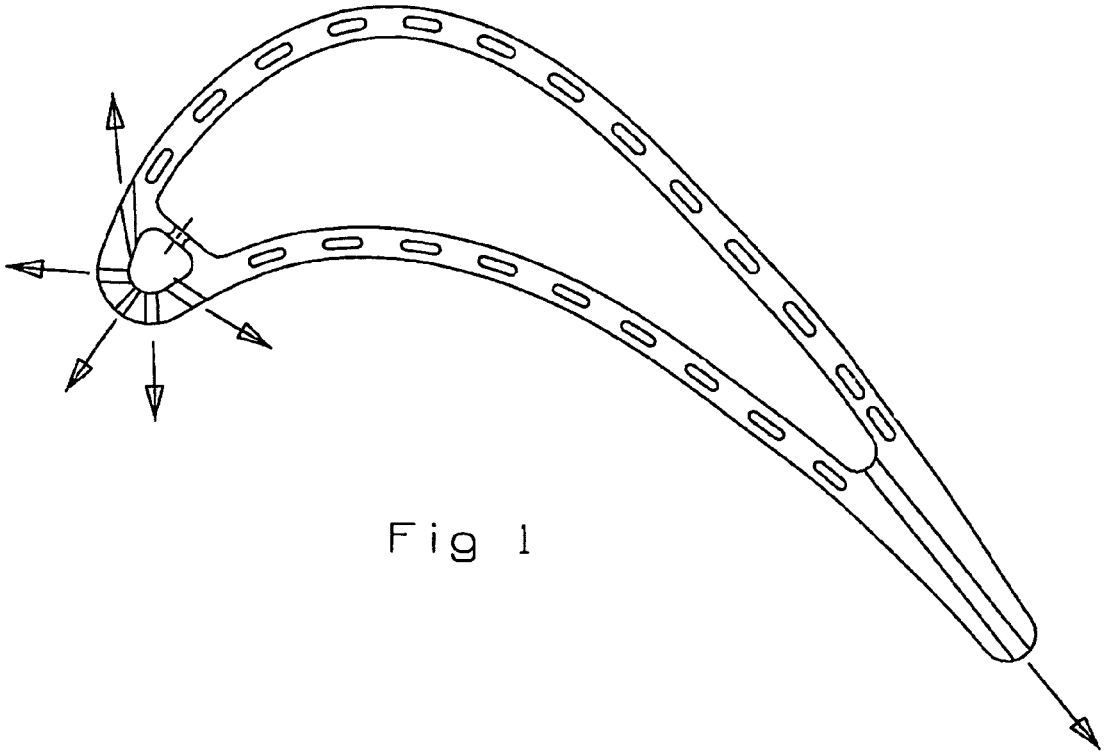
FIG. 1 shows a cross section top view of a prior art turbine blade with radial flow cooling passages.
Figure 2:
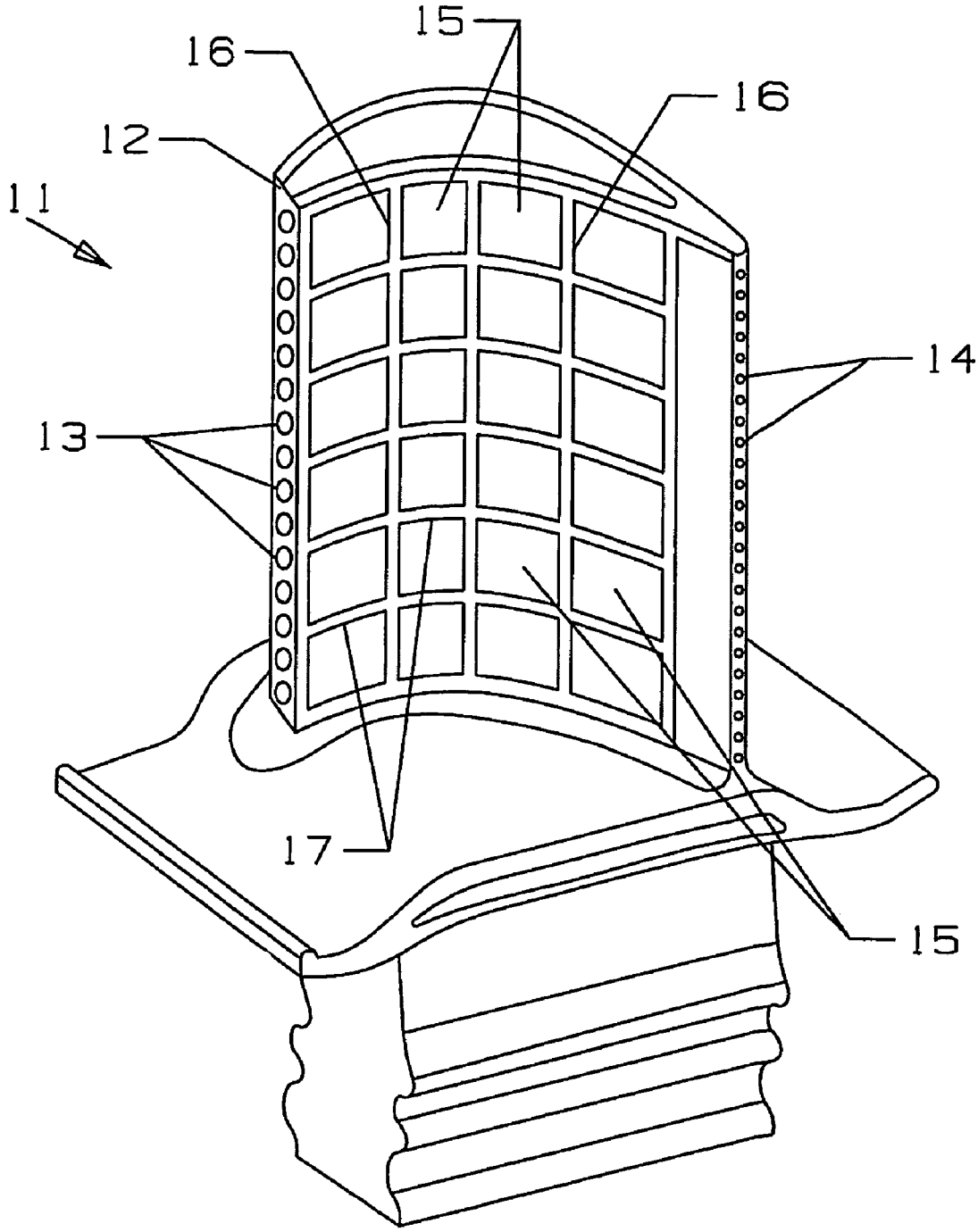
FIG. 2 shows a schematic view of the turbine blade of the present invention with the separate compartments formed on the pressure side wall.

FIG. 2 shows the turbine blade of the present invention without the thin thermal skin that forms the outer airfoil surface of the blade. The main spar 11 forms the cooling air passages and cavities for the blade and the support surface for the thin thermal skin. The main spar 11 is formed as a single piece by casting or a combination of casting and machining. For example, the mini serpentine flow cooling modules used in the present invention can be cast in or later machined into the outer surface of the main spar 11.

The main spar 11 extends from the blade root and platform and includes a leading edge side 12 with a row of impingement holes 13 extending along the spanwise direction. A row of exit holes 14 are formed along the trailing edge side of the main spar 11 and connect to the cavity formed adjacent to the trailing edge. An array of modules or cells 15 is formed on both the pressure side and the suction side of the main spar. The modules or cells 15 are separated from each other by spanwise extending ribs 16 and chordwise extending ribs 17. The modules 15 can be square or rectangular in cross sectional shape depending on the surface area to be cooled by the module.

Figure 3:
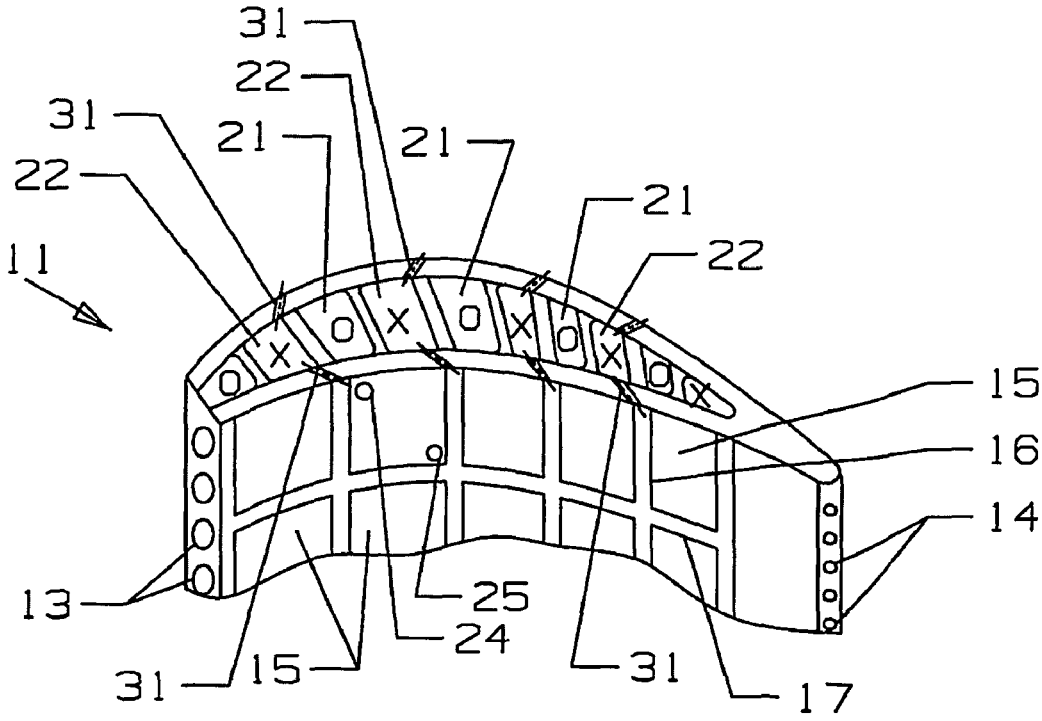
FIG. 3 shows a view of the cooling air supply cavities and collector cavities formed within the main spar, and the film cooling holes in the spanwise extending ribs.

FIG. 3 shows a top view from the pressure side wall of the main spar inner cavities. The main spar 11 defines a number of cooling air supply cavities 21 and cooling air collector cavities 22 that alternate in the chordwise direction from the leading edge region to the trailing edge region as seen in FIG. 3. The supply cavities and collector cavities extend along the airfoil spanwise direction from the platform to the blade tip. The supply cavities and the collector cavities extend from the pressure side to the suction side of the main spar 11. However, a spanwise extending rib can be used to divide the cavities into a pressure side and a suction side cavity if so desired. A cooling supply cavity 21 is located adjacent to the leading edge wall of the main spar to supply the impingement holes 13 with cooling air, and a collector cavity is located adjacent to the trailing edge region to supply the exit holes 14 with cooling air. each of the modules 15 includes a metering hole 24 connected to the adjacent cooling air supply cavity 21 and a discharge hole 25 connected to the adjacent collector cavity 22.

Figure 4:
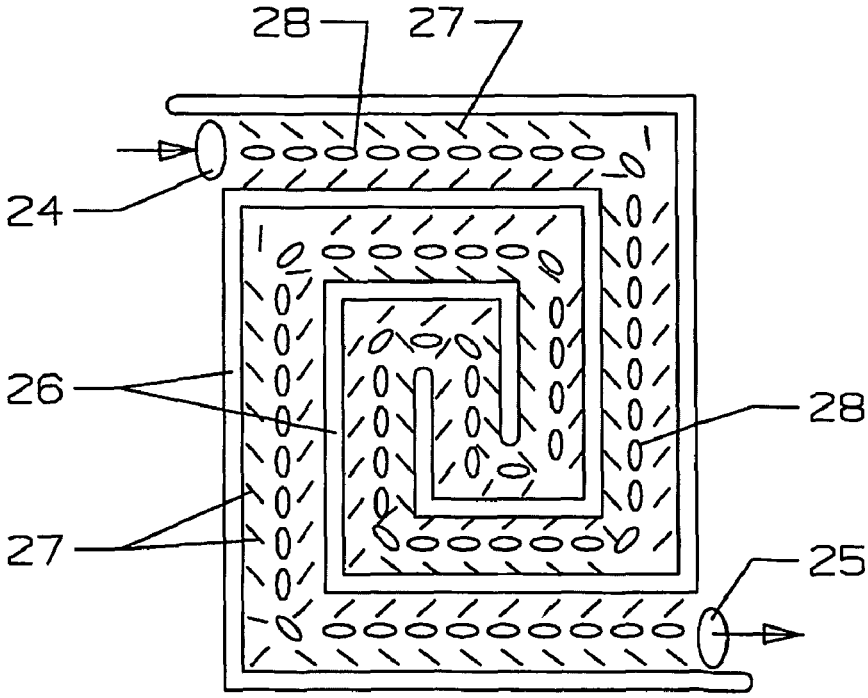
FIG. 4 shows a detailed view of one of the mini serpentine flow cooling modules used in the blade of the present invention.

FIG. 4 shows a detailed view of one of the mini serpentine flow cooling modules or cells 15 used on the main spar 11. The module forms a serpentine flow passage that spirals in toward the center and then spirals out to the outer side and on the opposite corner from the inlet as seen in FIG. 4. The metering hole 24 supplies the serpentine passage with cooling air from the supply cavity 21. The discharge hole 25 discharges the cooling air from the serpentine passage into the collector cavity 22. The spanwise ribs 16 and the chordwise ribs 17 enclose the module 15 while the internal serpentine ribs form the serpentine passage inside of the ribs 16 and 17. The serpentine passage includes trip strips 27 and micro pin fins 28 along the center of the serpentine passage to enhance heat transfer from the metal to the cooling air flowing through. These serpentine passage and trip strips and fins can be formed during the casting of the main spar 11 or machined into the main spar 11 after the casting process.

Figure 5:
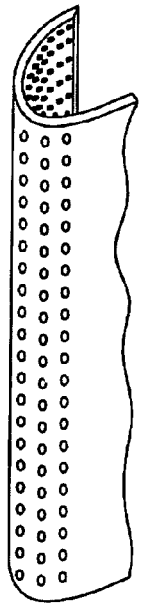
FIG. 5 shows a leading edge outer shell piece of the turbine blade of the present invention.
Figure 6:
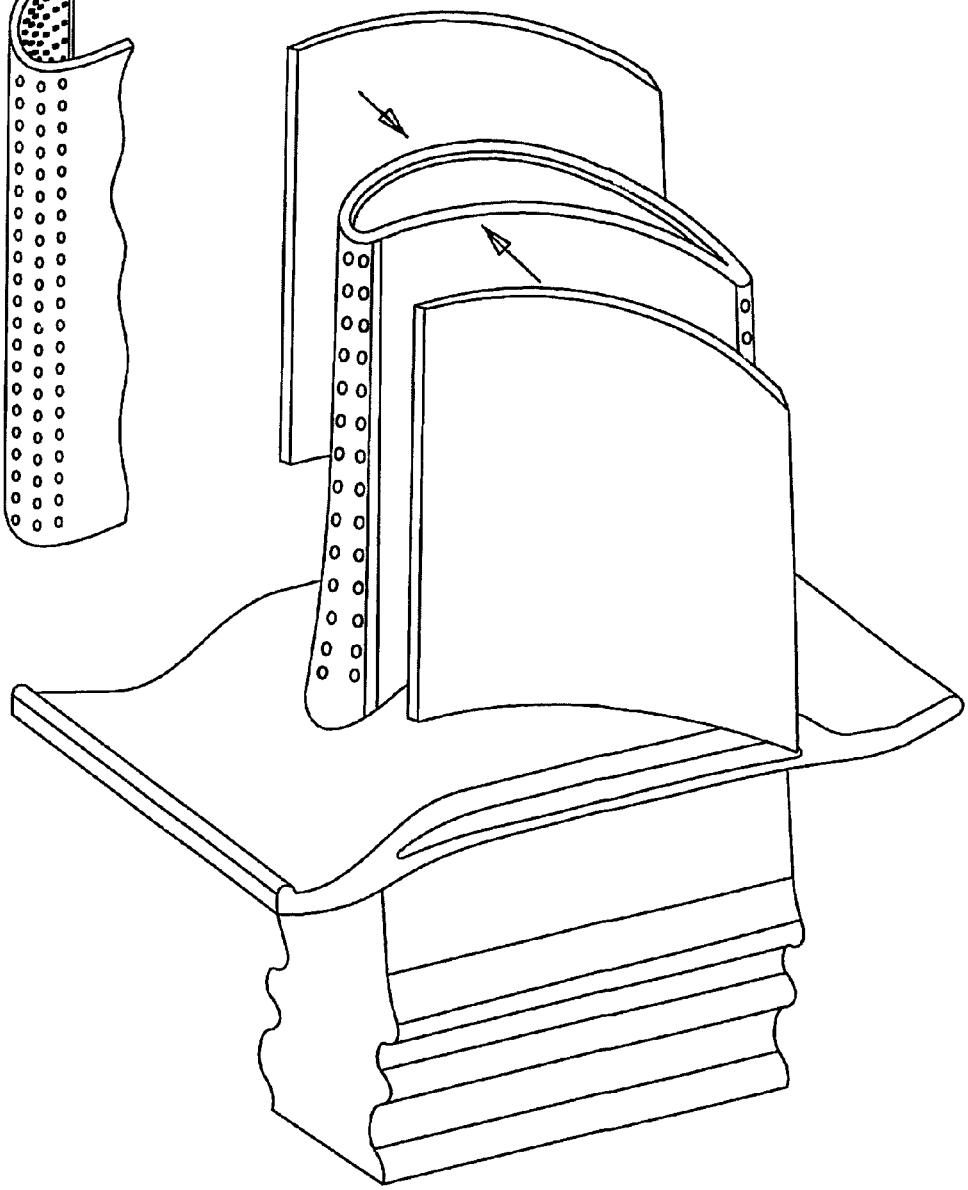
FIG. 6 shows the main spar and the outer thin thermal skin construction of the turbine blade of the present invention.

FIGS. 5 and 6 show how the turbine blade is formed. A thin thermal skin is bonded to the outer surface of the main spar to form the airfoil surface. In this embodiment, a leading edge section is bonded to the leading edge wall of the main spar to form the leading edge region of the airfoil. The thin thermal skin can be bonded using a transient liquid phase (TLP) bonding technique. The thin thermal skin includes micro pin fins formed along the inner surface to promote heat transfer and a showerhead arrangement of film cooling holes to discharge film cooling air from the leading edge impingement cavity that is formed when the leading edge thermal skin is bonded to the main spar. The pressure side and suction side of the thin thermal skin can be of one piece or from two or more pieces that is also bonded to the main spar by the TLP bonding process. The thin thermal skin on the pressure and suction sides are also formed with micro pin fins on the inner surface. The film holes in the thin thermal skin can be formed before or after the thin is bonded to the main spar. The thin thermal skin is formed from a material that will provide resistance to the hot gas flow while maintaining the airfoil shape for the blade under the high pressure and thermal loads. The thin thermal skin will have a thickness of from around 0.010 inches to 0.1030 inches in order to provide a very effective near wall cooling. With a thin wall, the heat transfer rate is high and therefore the metal temperature remains low compared to thicker walls. A thin wall of less than 0.030 inches cannot be cast using the prior art investment casting process because of limitations in the mold and the core used to form the metal features during the casting process.

Pressurized cooling air is supplies to one or more supply channels formed within the blade root and then into the supply cavities 21 formed within the main spar 11. From the cooling air supply cavities 21, the cooling air flows through the metering inlet holes 24 and through the individual serpentine flow passages formed within the modules 15 to provide near wall convective cooling for the airfoil surface. The cooling air is then discharged through the discharge holes 25 and into the collector cavities 22. The spent cooling air in the collector cavities 25 will then flow out through the film cooling holes 31 formed in the spanwise ribs 16 of the main spar.

For cooling of the leading edge and the trailing edge of the blade, a leading edge cooling supply cavity discharges the cooling air also through the row of metering and impingement holes 13 formed in the leading edge wall 12 to provide impingement cooling for the backside surface of the thin thermal skin and then film cooling discharge for the leading edge showerhead film holes. In the trailing edge, the collector cavity receives the spent cooling air from the row of modules along the trailing edge and then discharges the spent cooling air through the row of exit holes 14 arranged along the trailing edge region. The exit holes 14 can be exit slots arranged on the pressure side wall in the trailing edge region. The exit holes 14 can be of many shapes and sizes known in the prior art of turbine airfoils.

Because the individual modules 15 are separated from each other by the spanwise ribs and chordwise ribs, the metering inlet holes and discharge holes can be sized to regulate the amount of cooling air flow and pressure delivered to each module. Thus, the metal temperature of the airfoil under each module can be selectively controlled based on the metered cooling air flow through the module. Surfaces of the airfoil exposed to higher temperatures can be provided with more cooling air flow than other modules. Also, modules that discharge film cooling air from the discharge holes that are located at higher external gas flow pressures can be supplied with higher pressures of cooling air to prevent hot gas injection.

Thus, the individual modules or cells can be designed based on the airfoil gas side pressure distribution in both the chordwise and the spanwise directions. Also, each individual cell or module can be designed based on the airfoil local external heat load to achieve a desired local metal temperature in order to provide long blade life. The individual small modules can be constructed in a staggered array or an inline array along the airfoil main body wall. With the separated modules of the present invention, the usage of cooling air is maximized for the given airfoil inlet gas temperature and pressure profile is achieved that cannot be achieved in the cited prior art turbine blades.

The film holes in the spanwise ribs that are connected to the collector cavities forms very high film coverage for a very high cooling effectiveness and uniform wall temperature for the airfoil main body.

I claim the following:

1. An air cooled turbine blade comprising:

a main spar with a pressure side surface and a suction side surface;

the main spar forming a cooling air supply cavity and a cooling air collector cavity between the pressure side surface and the suction side surface;

the supply cavity being located adjacent to the collector cavity;

a row of spanwise extending cells formed on the pressure side surface of the main spar, each cell forming a serpentine flow passage; and, each cell including a metering inlet hole connected to the supply cavity and a discharge hole connected to the collector cavity.

2. The air cooled turbine blade of claim 1, and further comprising:

each of the cells is separated from adjacent cells by ribs formed on the main spar such that each cell forms a separate cooling air passage.

3. The air cooled turbine blade of claim 1, and further comprising:

the main spar includes rows of chordwise extending ribs and spanwise extending ribs to form an array of separate cells; and, each cell forms a serpentine flow cooling passage with an inlet metering hole connected to a cooling air supply cavity; and, each separate cell includes a discharge hole connected to a cooling air collector cavity.

4. The air cooled turbine blade of claim 3, and further comprising:

the separate cells occupy most of the airfoil surface.

5. The air cooled turbine blade of claim 3, and further comprising:

a thin thermal skin bonded to the main support spar to form the airfoil surface and to enclose the cells to form the separate serpentine flow cooling passages.

6. The air cooled turbine blade of claim 5, and further comprising:

the thin thermal skin has a thickness of from around 0.010 inches to around 0.030 inches.

7. The air cooled turbine blade of claim 2, and further comprising:

the ribs include spanwise extending ribs and include a row of film cooling holes connected to the collector cavity.

8. The air cooled turbine blade of claim 1, and further comprising:

a plurality of rows of spanwise extending modules separated by a spanwise extending rib; and, each row of spanwise extending modules being connected to a cooling supply cavity to supply cooling air to the cell and a collector cavity to discharge cooling air from the cell.

9. The air cooled turbine blade of claim 1, and further comprising:

the spanwise extending ribs includes film cooling holes connected to the collector cavities to discharge film cooling air onto an outer airfoil surface.

10. The air cooled turbine blade of claim 1, and further comprising:

each of the cells includes a mini serpentine flow cooling passage with trip strips and pin fins to promote heat transfer.

11. The air cooled turbine blade of claim 10, and further comprising:

the mini serpentine flow passages include an inlet near one corner of the cell, and outlet near an opposite corner of the cell, and the serpentine flow passage spirals inward toward a center of the cell and then spirals outward toward the outlet.

12. The air cooled turbine blade of claim 11, and further comprising:

the mini serpentine flow passages are formed by straight channels that extend in either the spanwise direction or the chordwise direction of the airfoil.

13. The air cooled turbine blade of claim 1, and further comprising:

a thin thermal skin bonded to the main spar to form the airfoil surface;

a cooling air supply cavity located adjacent to the leading edge region; and, a row of metering and impingement holes connecting the leading edge cooling air supply cavity with a leading edge impingement cavity formed by the thin thermal skin.

14. The air cooled turbine blade of claim 13, and further comprising:

a row of exit holes formed along the trailing edge region of the airfoil and connected to a collector cavity located adjacent to the trailing edge region of the airfoil.

15. The air cooled turbine blade of claim 1, and further comprising:

a row of exit holes formed along the trailing edge region of the'airfoil and connected to a collector cavity located adjacent to the trailing edge-region of the airfoil.

16. The air cooled turbine blade of claim 1, and further comprising:

the suction side surface includes an array of cells;

each cell including a supply hole connected to a cooling air supply cavity to supply cooling air to the serpentine flow passage formed within the cells;

each cell also including a discharge hole connected to a cooling air collector cavity to discharge cooling air from the serpentine flow passage.

17. The air cooled turbine blade of claim 1, and further comprising:

the cells are all the same size.

* * * * *